US005382031A

United States Patent [19]

Marconato et al.

[11] Patent Number: 5,382,031

[45] Date of Patent: Jan. 17, 1995

[54] SKATE WITH IMPROVED STEERING CAPABILITIES

[75] Inventors: Luca Marconato, Padernello Di Paese; Alessandro Pozzobon, Paderno Di Ponzano Veneto, both of Italy

[73] Assignee: Nordica S.p.A., Trevignano, Italy

[21] Appl. No.: 965,279

[22] PCT Filed: Jun. 5, 1992

[86] PCT No.: PCT/EP92/01263

§ 371 Date: Feb. 1, 1993

§ 102(e) Date: Feb. 1, 1993

[87] PCT Pub. No.: WO92/22363

PCT Pub. Date: Dec. 23, 1992

[30] Foreign Application Priority Data

Jun. 11, 1991 [IT] Italy ..... TV91A000065

[51] Int. Cl.[6] ..... A63C 17/04

[52] U.S. Cl. ..... 280/11.22

[58] Field of Search ..... 280/11.22, 11.27, 11.19, 280/11.23

[56] References Cited

U.S. PATENT DOCUMENTS

| | | | |
|---|---|---|---|
| 280,236 | 6/1883 | Phillips | 280/11.19 |
| 954,993 | 4/1910 | Peters | 280/11.19 |
| 3,900,203 | 8/1975 | Kukulowicz | 280/11.22 |
| 5,183,276 | 2/1993 | Pratt | 280/11.19 |

*Primary Examiner*—Richard M. Camby

*Attorney, Agent, or Firm*—Guido Modiano; Albert Josif; Daniel O'Byrne

[57] ABSTRACT

A skate having a support for the sole of an item footwear and for at least three aligned wheels, which has improved turning. The peculiarity of the skate consists of the fact that two wheels are arranged and rotate on a plane which is parallel to the plane of the remaining wheels. It is thus possible to obtain a right skate and a left skate with offset wheels which allow the user to achieve better turning.

10 Claims, 1 Drawing Sheet

SKATE WITH IMPROVED STEERING CAPABILITIES

BACKGROUND OF THE INVENTION

The present invention relates to a skate with improved steering capabilities.

Skates having aligned wheels are currently known, and they are ever more specifically used for speed skating and slalom.

The problem observed in these known types of skates, in which the wheels are pivoted at adapted supports which are rigidly associated with a supporting plate for the sole of an item of footwear, consists in the difficulty in achieving very tight turning radiuses.

Devices are known which allow to vary the distance of the axis of the wheels with respect to the ground, in order to adapt the skate to slalom or speed.

However, said devices are not practical to use and are expensive.

DE-G-9107661.7, for example, discloses such a skate with steering wheels.

SUMMARY OF THE INVENTION

The aim of the present invention is therefore to eliminate the problems described above in known types by providing a skate with aligned wheels by which it is possible to achieve a very tight turning radius.

Within the scope of the above aim, an important object is to provide a skate wherein turning can be achieved in a practical and easy manner for the athlete, requiring very little effort.

Another important object is to provide a skate which allows to achieve a turning radius which is as much as possible continuous, by means of devices having an extremely low cost.

Another important object is to provide a skate which is structurally simple and can be obtained with known machines and facilities.

Not least object is to provide an invention which associates with the preceding characteristics those of having low costs and of being at the same time reliable and safe in use.

This aim, the objects mentioned and others which will become apparent hereinafter are achieved by a skate with improved steering capabilities, comprising a support for the sole of an item of footwear and for at least three aligned wheels, characterized in that at least one of said wheels, which is arranged approximately in the median region, is arranged and rotates on a plane which is parallel to the plane of the remaining wheels.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

DESCRIPTION OF THE PREFERRED EMBODIMENTS

Figures 1, 2, 3, 4:
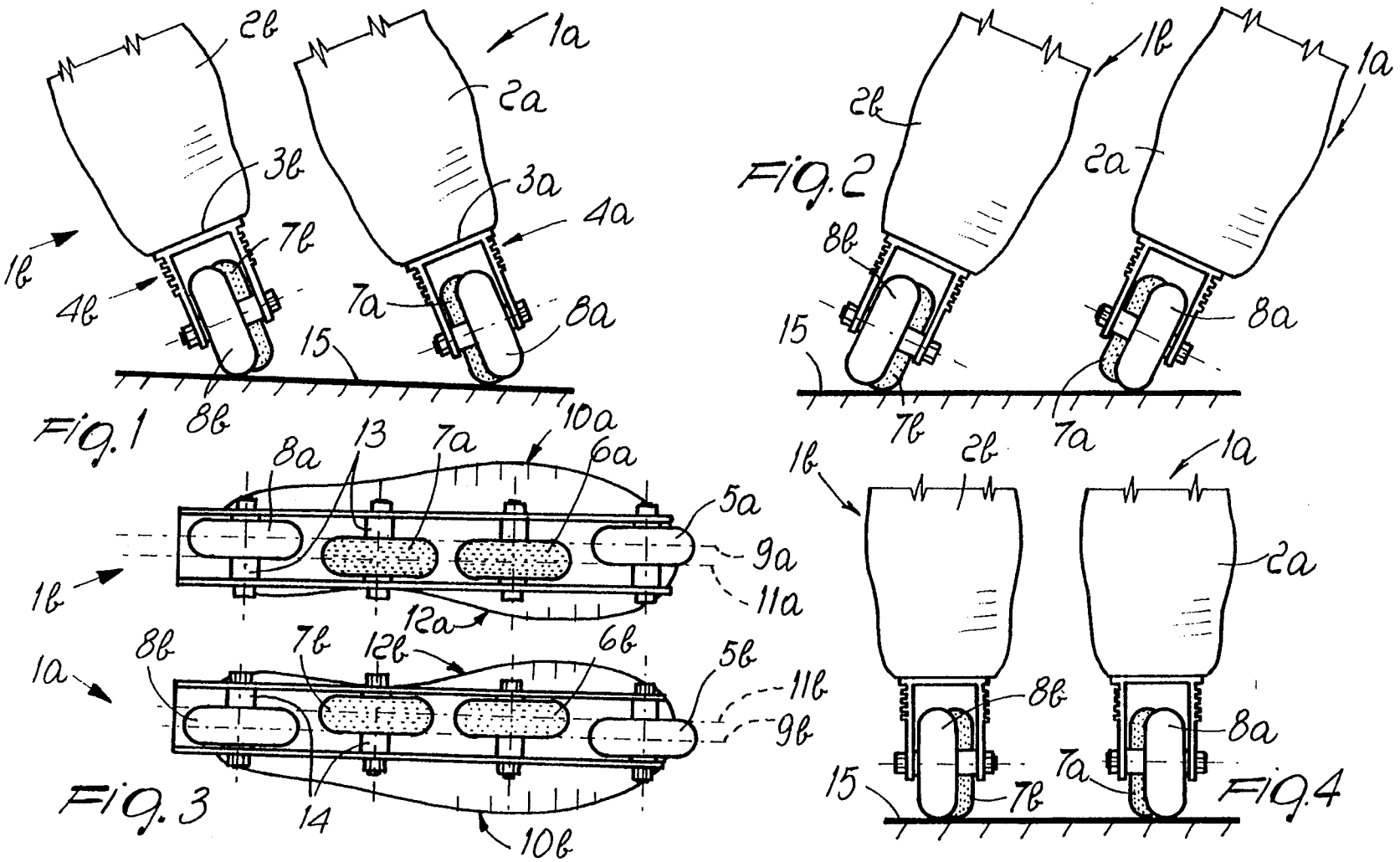
FIG. 1 is a rear view of a pair of skates during the execution of a left turn.
FIG. 2 is a view, similar to the preceding one, of the pair of skates during the execution of a right turn.
FIG. 3 is a schematic top view of the pair of skates, according to the invention, showing the position of the wheels.
FIG. 4 is a rear view of the pair of skates in the straight-line motion condition.

With reference to the above FIGURES, a skate structure composed of a right skate and of a left skate, generally designated by the reference numerals 1*a* and 1*b*, will be considered specifically.

Each of the skates is constituted by an item of footwear, designated by the reference numerals 2*a* and 2*b*. A plate, designated by the reference numerals 3*a* and 3*b*, is associated at the sole of the item of footwear. A support, designated by the reference numerals 4*a* and 4*b*, and constituted by a pair of parallel wings, protrudes from the plate. Four aligned wheels are pivoted, between the wings. The wheels are designated by the reference numerals 5*a*, 5*b*, 6*a*, 6*b*, 7*a*, 7*b*, 8*a* and 8*b* respectively starting from the tip of the item of footwear toward the heel thereof.

The number of aligned wheels can range from a minimum of three upward. In the present case, an embodiment with four aligned wheels is described.

At each skate 1*a* and 1*b*, the wheels 5*a*, 5*b* adjacent to the tip of the item of footwear and the wheels 8*a*, 8*b* adjacent to the heel thereof are arranged and rotate at a same first plane designated by the numerals 9*a* and 9*b*.

Said first plane is advantageously arranged parallel to the median plane which is longitudinal to the supports 4*a* and 4*b*, preferably directed toward the outer lateral edge 10*a* and 10*b* of the items of footwear 2*a* and 2*b*.

The remaining wheels 6*a*, 6*b* and 7*a*, 7*b*, which are located centrally with respect to the supports 4*a*, 4*b*, are also arranged and rotate in a same second plane, designated by the numerals 11*a* and 11*b*, which is parallel to the first plane 9*a*, 9*b*.

In particular, said second plane 11*a*, 11*b* is arranged adjacent to the inner lateral edge 12*a*, 12*b* of the item of footwear 2*a*, 2*b*.

The arrangement of the various wheels can be achieved by interposing adapted spacers, designated by the reference numerals 13 and 14, on the axes of said wheels.

The arrangement of the wheels is such that, as illustrated in FIG. 4, during skating along a straight axis all of said wheels interact with the ground 15.

The operation of the skate structure is thus as follows: when following a straight path, all the wheels interact directly with the ground, ensuring excellent directionality to the skate.

If a turn is made, for example to the right as shown in FIG. 2, the left skate 1*b* interacts with the ground 15 only at the wheels 6*b* and 7*b* which, by being located in the median region of the support 4*b*, allow the user to achieve better control of the turning action, by having a very small center distance; the right skate 1*a* performs the function of increasing or maintaining the initial speed.

A similar situation occurs for the right skate 1*a* and the left skate 1*b* in a left turn.

It is also noted that along straight paths the user can enjoy a better support, since the wheels, despite being aligned, are arranged on mutually parallel planes, thus increasing stability during motion.

It has thus been observed that the invention has achieved the intended aim and objects, a skate having been provided which allows to achieve better turning as well as excellent support during straight-line skating.

The skate according to the invention is susceptible to numerous modifications and variations, all of which are within the scope of the same inventive concept.

Thus, for example, if there are three aligned wheels, the central one is axially offset with respect to the one located in the regions adjacent to the tip and heel of the item of footwear.

Similarly, if there are more than four aligned wheels, at least one of them, arranged approximately in the median region or in a region directly adjacent thereto, is arranged and rotates on a plane which is parallel to another plane on which one or more of the remaining wheels are arranged.

The materials and the dimensions which constitute the individual components of the skate may naturally also be the most pertinent according to the specific requirements.

We claim:

1. Skate with improved steering capabilities, comprising a support for the sole of an item of footwear and for at least three aligned wheels, wherein at least of said wheels, which is arranged approximately in the median region, is arranged and rotates on a plane which is parallel to the plane of the remaining wheels, the skate comprising a right skate and a left skate, each of which has four aligned wheels, wherein at each skate, two of said four wheels, which are adjacent to the tip and heel of said item of footwear, are arranged and rotate at a same first plane which is arranged parallel to the median plane which is longitudinal to said support and is directed toward the outer lateral edge of said right and left skates.

2. Skate according to claim 1, wherein the remaining two wheels of said four, which are arranged centrally to said support, are arranged and rotate at a same second plane which is parallel to said first plane and is arranged adjacent to the inner lateral edge of said right and left skates.

3. Skate according to claim 1, wherein said wheels are arranged on their axes with respect to said support by interposing adapted spacers.

4. Skate according to claim 1, wherein all of said three or more aligned wheels interact with the ground during straight-line skating.

5. Skate according to claim 1, wherein, when turning to the right, said at least one wheel arranged approximately in the median region of said left skate interacts with the ground.

6. Skate according to claim 1, wherein, when turning to the left, said at least one wheel arranged approximately in the median region of said right skate interacts with the ground.

7. Skate according to claim 1, wherein at least the central wheel is arranged and rotates on a plane which is parallel to the plane of arrangement of the remaining wheels.

8. Skate according to claim 1, wherein at least one wheel arranged approximately in the median region of said support is arranged and rotates on a plane which is parallel to the plane of arrangement of the remaining wheels.

9. A skate with improved steering capabilities, comprising:

an item of footwear with a bottom;

a support element for rotatably supporting wheels, said support element being connected to said bottom of said item of footwear, said support element having a longitudinal axis; and a group of wheels rotatably supported by said support element;

wherein said group of wheels consists of:

a first set of wheels comprising at least one first wheel rotatably supported by said support element about a first pivot axis and arranged at a position to a first side of said longitudinal axis; and a second set of wheels comprising at least two second wheels rotatably supported by said support element about second pivot axes and arranged at a position to a second side of said longitudinal axis opposite to said first side;

and wherein said first set of wheels have their respective said first pivot axes arranged between, with respect to said longitudinal axis, said second pivot axes of said second set of wheels, and wherein said first set of wheels comprises two first wheels rotatably supported by said support element about first pivot axes, said first pivot axes both being arranged between said second pivot axes with respect to said longitudinal axis.

10. The skate of claim 9, wherein said position to a first side of said longitudinal axis is arranged toward an inner lateral edge of the skate, and wherein said position to a second side of said longitudinal axis is arranged toward an outer lateral edge of the skate.

* * * * *